US011465799B2

(12) United States Patent
Dammers et al.

(10) Patent No.: US 11,465,799 B2
(45) Date of Patent: Oct. 11, 2022

(54) COMPOSITE PACKAGE, PACKAGE LAMINATE AND PACKAGE SLEEVE BLANK FOR A COMPOSITE PACKAGE

(71) Applicant: SIG Technology AG, Neuhausen am Rheinfall (CH)

(72) Inventors: Matthias Dammers, Alsdorf (DE); Magdalena Gärtner, Aachen (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 16/087,874

(22) PCT Filed: Apr. 3, 2017

(86) PCT No.: PCT/EP2017/025072

§ 371 (c)(1),
(2) Date: Sep. 24, 2018

(87) PCT Pub. No.: WO2017/174210

PCT Pub. Date: Oct. 12, 2017

(65) Prior Publication Data

US 2019/0337667 A1 Nov. 7, 2019

(30) Foreign Application Priority Data

Apr. 4, 2016 (EP) ..... 16020106

(51) Int. Cl.
*B65D 5/06* (2006.01)
*B65D 5/02* (2006.01)
(Continued)

(52) U.S. Cl.
CPC ..... *B65D 5/064* (2013.01); *B65D 5/0209* (2013.01); *B65D 5/4266* (2013.01); *B65D 5/746* (2013.01); *B65D 65/40* (2013.01)

(58) Field of Classification Search
CPC .... B65D 5/064; B65D 5/0209; B65D 5/4266; B65D 5/746; B65D 65/40; B65D 5/029; B65D 5/067; B29L 2031/7166
(Continued)

(56) References Cited

U.S. PATENT DOCUMENTS 4,846,396 A 7/1989 Palazzolo
5,738,272 A * 4/1998 Anchor ..... B65D 5/029 229/109

(Continued)

FOREIGN PATENT DOCUMENTS

CA 1273324 A 8/1990
CN 1217695 A 5/1999

(Continued)

OTHER PUBLICATIONS

"Portion Package for Pourable Food Products" Research Disclosure, Mason Publications, Hampshire, GB, 1998, vol. 414:41.

(Continued)

*Primary Examiner* — Christopher R Demeree
(74) *Attorney, Agent, or Firm* — The Webb Law Firm

(57) ABSTRACT

A composite package, in particular a beverage carton package for liquid foodstuffs is depicted and described which consists at least partially of a package laminate, having a package base body including package edges, an at least partially angular package base and package gable wherein the package base body defines, in an idealised manner, a package front side, package rear side and at least two lateral package sides attaching to the package rear side as well as a package laminate and a package sleeve blank for manufacturing such a composite package. In order to improve grip and ergonomy for an easy to manufacture package, provision is made for the package front side to have a positive arching at least in sections which in each case passes into a (Continued)

lateral package side for a grip panel to be formed at least in sections in the region of the package rear side.

15 Claims, 6 Drawing Sheets

(51) Int. Cl.
*B65D 5/42* (2006.01)
*B65D 5/74* (2006.01)
*B65D 65/40* (2006.01)

(58) Field of Classification Search
USPC ..... 229/124, 126, 125.42, 137, 249, 915.1, 229/106, 125.04, 138, 213, 214, 248, 4.5
See application file for complete search history.

(56) References Cited

U.S. PATENT DOCUMENTS

| | | | | |
|---|---|---|---|---|
| 5,938,107 | A | 8/1999 | Anchor et al. | |
| D473,464 | S | 4/2003 | Anchor et al. | |
| 6,929,171 | B1 * | 8/2005 | Thiersch | B65D 5/029 229/108 |
| 6,938,819 | B2 * | 9/2005 | Bergerioux | B65D 5/727 220/258.2 |
| 7,523,853 | B2 * | 4/2009 | Kortsmit | B65D 5/067 229/108 |
| 7,571,846 | B2 * | 8/2009 | Berglin | B65D 5/746 229/125.15 |
| 7,753,255 | B2 * | 7/2010 | Kieser | B65D 5/748 229/125.15 |
| 8,851,361 | B2 * | 10/2014 | Daley | B65D 5/061 229/137 |
| 9,227,750 | B2 * | 1/2016 | Franic | B65D 5/029 |
| 9,327,862 | B2 | 5/2016 | Barbieri et al. | |
| 9,611,065 | B2 * | 4/2017 | Franic | B65D 5/746 |
| 10,384,825 | B2 | 8/2019 | Benko et al. | |
| 2004/0011688 | A1 | 1/2004 | Ishikawa | |
| 2006/0144912 | A1 * | 7/2006 | Franic | B65D 5/029 229/125.15 |
| 2006/0264308 | A1 | 11/2006 | Dammers et al. | |
| 2008/0135607 | A1 | 6/2008 | Barthel et al. | |
| 2008/0223912 | A1 | 9/2008 | Ayats Ardite et al. | |
| 2011/0113733 | A1 | 5/2011 | Franic | |
| 2012/0279182 | A1 * | 11/2012 | Barbieri | B65D 5/4266 53/456 |
| 2016/0214757 | A1 | 7/2016 | Barbieri et al. | |
| 2019/0337667 | A1 | 11/2019 | Dammers et al. | |

FOREIGN PATENT DOCUMENTS

| | | | |
|---|---|---|---|
| CN | 1446167 | A | 10/2003 |
| CN | 1777538 | A | 5/2006 |
| CN | 101001785 | A | 7/2007 |
| CN | D201030154036.8 | | 8/2010 |
| CN | 102099256 | A | 6/2011 |
| CN | 102481998 | A | 5/2012 |
| CN | 102666292 | A | 9/2012 |
| CN | 206782263 | U | 12/2017 |
| DE | 10326106 | A1 | 12/2004 |
| EM | 00142567 | | 6/2006 |
| EM | D001170039-0001 | | 4/2012 |
| EM | D001170039-0002 | | 4/2012 |
| EM | D001170039-0003 | | 4/2012 |
| EM | D001383210-0019 | | 10/2013 |
| EM | 003758937 | | 3/2017 |
| EP | 0144736 | A2 | 6/1985 |
| EP | 0277673 | A1 | 8/1988 |
| EP | 1316508 | A1 | 6/2003 |
| EP | 1338521 | A1 | 8/2003 |
| EP | 2392517 | A1 | 12/2011 |
| IT | D2000TOO000049-4 | | 5/2000 |
| IT | D2000TOO000049-6 | | 5/2000 |
| JP | 2000506821 | A | 6/2000 |
| JP | 2001213427 | A | 8/2001 |
| JP | 1233843 | S | 3/2005 |
| JP | 2006518691 | A | 8/2006 |
| JP | 2008504181 | A | 2/2008 |
| JP | 2010527866 | A | 8/2010 |
| JP | 2012197082 | A | 10/2012 |
| JP | 2013531587 | A | 8/2013 |
| WO | 03045794 | A1 | 6/2003 |
| WO | 2005090168 | A1 | 9/2005 |
| WO | 2005097606 | A2 | 10/2005 |
| WO | 2006000285 | A1 | 1/2006 |
| WO | 2009101029 | A1 | 8/2009 |
| WO | D070763 | | 9/2009 |
| WO | 2011064536 | A2 | 6/2011 |
| WO | 2011120857 | A1 | 10/2011 |
| WO | D096788 | | 5/2017 |

OTHER PUBLICATIONS

Pelz, "Carton Council speaks on increased recycling opportunities," Greener Package, Jul. 2, 2014, 2 pages.
Snapshot, https://silk.com/products, Feb. 1, 2016.
Blechschmidt, "Papierverarbeitungstechnik", Hanser, 19 pages.

* cited by examiner

COMPOSITE PACKAGE, PACKAGE LAMINATE AND PACKAGE SLEEVE BLANK FOR A COMPOSITE PACKAGE

CROSS-REFERENCE TO RELATED APPLICATIONS

This application is the United States national phase of International Application No. PCT/EP2017/025072 filed Apr. 3, 2017, and claims priority to European Patent Application No. 16020106.7 filed Apr. 4, 2016, the disclosures of which are hereby incorporated in their entirety by reference.

The invention relates to a composite package, in particular to a beverage carton package for liquid foodstuff which at least partially consists of a package laminate, having a package base body comprising package edges, an at least partially angular package base and an at least partially angular package gable, wherein the package base body defines, in an idealised manner, a package front side, a package rear side and at least two lateral package sides attached to the package rear side which spread out substantially at intended projections through the respective package base corners and the respective package gable corners and are delimited in the gable and base region.

The invention also relates to a package laminate having at least one carton support layer and one polymer layer, having a plurality of creases incorporated into the material in order to predefine package fold lines to form package edges.

Finally the invention relates to a package sleeve blank consisting of a package laminate having at least one carton carrier layer and a polymer layer, with a plurality of creases worked into the material to predefine package fold lines for the formation of package edges, the package laminate being cut to size at the interval of a composite package and being joined by a longitudinal sealing seam to form a tube.

Description of Related Art

In the field of package technology, composite packages have long since belonged to the common prior art. Thus there are for example beverage cartons made from different package materials such as paper and plastic which form a package laminate when completely joined and printed. The layer structure can vary depending on requirements, thus an aluminium layer is also inserted for example for aseptic filling materials in order to achieve a good barrier effect against gases and light.

The actually shaping and filling of the package and the closing to form a package occurs in a package machine which is frequently designated as a form, fill, seal machine following its main functions. In this case, the tube and the sleeve process have been established. Whereas in the case of the former, the package laminate is supplied as an endless material (rolled web material) to the machine, in the case of the latter the package laminate is already cut to the interval of a package. Such cuts are also frequently transferred to a pipe and connected by a longitudinal sealing seam to so-called package sleeve blanks which are then available to a corresponding machine for processing as semi-finished products. In the present case, liquid foodstuffs such as beverages, soups or yogurts are considered as filling materials. Solidified, pasty or lumpy products or the like are also conceivable.

The package is made by deforming, joining and sometimes even separating processes of the package laminate or package sleeve blank. To this end, the material is inter alia folded (machine folded) such that for example package base and package gable can be formed and package edges result on the package base body. In order to give the material the required bending properties, corresponding creases are incorporated during the production thereof. Such grooving during the production thereof is for example shown in the German patent application DE 10326106 A1 traced back to the applicant. The exemplary embodiment shows a creased package sleeve blank suitable for the sleeve process. Package aids, which are increasingly demanded by the consumer market, such as for example reclosable closures, opening and pouring devices, straws, pull tabs, etc., often require an additional pre-treatment of the package laminate, for example in the form of locally incorporated weaknesses such as prelaminated holes or special perforations or the like.

Meanwhile, the most varied of package forms are known and available. There are thus package bodies with specially formed edges, additional panels, rounded regions and arched surfaces. The top region of the package is closed by, for example, a flat gabletop or a slanted gabletop (for example as a saddle roof or a monopitch roof) or by more specific shapes. Separately made moulded parts are also conceivable for the head region and base of the package.

A special requirement for the mentioned composite packages is to always provide the consumer with a good grip of the package.

European application EP 1 316 508 A1 shows a substantially box-shaped package, made here in the tube process wherein all lateral edges are broken and additional panels result. It is supposed to inter alia allow a package to be more easily (laterally) picked out and isolated from the shelf. In addition to extensive material preparations (creases), complex deformation processes are required which frequently affect the dimensionally stability of the package. Such "hard" package shapes are also not always desirable to the consumer with respect to the appearance of the package, however also with regard to the tactual and/or haptic properties.

European application EP 0 144 736 A2 already proposes "softer" shapes. The package is complexly formed from a separate head part and a rounded base body. In order to facilitate the gripping and pouring for the consumer even with a round form, long fold lines are formed in connection with shape transition fold lines.

Recently, packages with specially rounded and arched surfaces are also known for example from the international patent application WO 2009/101029 A1. Parallel structural lines are incorporated into the package base body at the gable in order to provide the consumer with an improved surface grip. The package base is formed by a separate round insert part which is relatively complexly connected to the package body (for example crimped).

A special solution for a composite package improved with respect to the grip properties, made here in the sleeve process and the associated package sleeve blank is known from the international application WO 2005/097606 A2. In this case, crease patterns are introduced into the package base body in such a way that when gripping with thumbs and fingers, a local inward deformation of the package is enabled which should improve holding and pouring and/or the surface grip. It is often shown that packages of the mentioned type fail even before consumption and undesired deformations occur as early as distribution or display. A deformation frequently also leads to uncontrolled pouring to spilling of the product.

Finally, complexly produced special shapes have also been proposed, such as for example those which are disclosed in the international patent application WO 2011/120857 A1. The package comprises a package base folded in a "D"-shape. Grip depressions are incorporated in the package base body. The head part of the package is produced in a polymer part.

SUMMARY OF THE INVENTION

It is therefore an object of the present invention to design and further develop a composite package, a package laminate and a package sleeve blank of the type mentioned in the introduction and previously described in greater detail such that the described disadvantages are overcome. In particular, grip and ergonomy are supposed to be improved for a package that is easy to produce.

This object is achieved for a composite package according to the preamble of Claim 1 by the package front side having a positive arching at least in sections, extending over the projections defining the front side of the package and in each case passing into a lateral package side and wherein a grip panel is formed at least in sections in the region of at least one of the projections defining the package rear side. A package base body shaped in this manner allows a consumer to grip and hold the package particularly well. If the package is grasped and held for example in a human gripping force, i.e. with thumbs and ball of thumbs in opposition to the other four fingers, it lies particularly well in the hand. If the consumer is for example supposed to drink directly from the package (on the go) or the content is supposed to be poured into a drinking glass, thus the two curved thumbs enclose the curved arching of the package front side on the one hand and a particularly good gripping region and holding grip is provided for the four fingertips of the other fingers with the "edge-free" region. The largely planar contact surface of the grip panel improves both the feel and the tactility, particularly also for the contact of the fingertips, which enhances the grip additionally. Moreover, the panels in connection with a coherent decor are able to signalise predetermined gripping/areas to the consumer. The complete abandonment of a throughout package edge or crease at the front allows both an improved grip and hold ergonomics and a facilitated manufacturing and prearrangement of the materials.

The object underlying the invention is also achieved by a package laminate which is made such that it is suitable for producing such a composite package.

The package sleeve blank according to the invention is lastly made such that such a composite package can be manufactured.

A further teaching of the invention envisages that grip panels are formed at least in sections in the region of both projections defining the package rear side. If an "edge-free" section is formed at both rear side ends, then two grip regions are available. However, if the first (innermost) and third (outermost) finger digit of the other four fingers (without thumbs) can be used, then a particularly good grip ability results since an additional "forceps effect" is employed between the involved digits of a finger.

Further types of the embodiments according to the invention envisage that in two projections defining the package rear side package edges are formed at least in the region of the rear package base corners and/or rear package gable corners. This facilitates the manufacture of the package since the critical corner regions thus always remain defined by edges and greater loads in the material are prevented.

According to a further teaching of the invention, the positive arching is longer than half the height of the package base body. Such an extension of the arching leaves enough space for thumbs and balls of the thumb when clasping this region.

According to a further expedient embodiment, the package gable is chamfered with respect to the package base body and/or the gable front edge is curved. This enlarges the package gable and facilitates the manufacture in this region since the foldings do not have to take place in sections over a complete right angle. The required tilt angle for a complete package emptying is also minimised such that the package is easier to handle. Since the gable front edge is curved, particularly if for example the positive arching of the front side leads up to the gable front edge, the transition from the package gable to the arched package base body is hereby enabled.

A further design of the composite package envisages that the package gable consists of package laminate. If additional insert or mould parts that are made in a different manner are dispensed with, this generally facilitates the manufacture of the package.

In a further design of the invention, the package gable comprises a transverse sealing seam and/or comprises package ears laterally connected to the package base body. If the package is closed in the region of its gable, this enables easier manufacture.

According to a further teaching of the invention, the package gable comprises a weakening of the package laminate and/or a pouring element is applied on the package gable if appropriate. Additional pouring or removal aids, for example in the form of a straw or pouring element, are often desired. The package laminate frequently has to be specially prepared for this purpose, for example in the form of pre-laminated holes or perforations. Such package aids that facilitate the use and handling increase the convenience and acceptance for the consumer.

According to other embodiment types of the invention, the package base comprises precisely four base corners and is formed as a block base if appropriate. This enables simple fold processes and facilitates the manufacture of the block base. However, these regularly contribute to the good stability and strength of the package, which often facilitates its handling.

BRIEF DESCRIPTIONS OF THE DRAWINGS

The invention is explained in detail below on the basis of drawings showing an exemplary embodiment. The drawings show:

Figure 1:
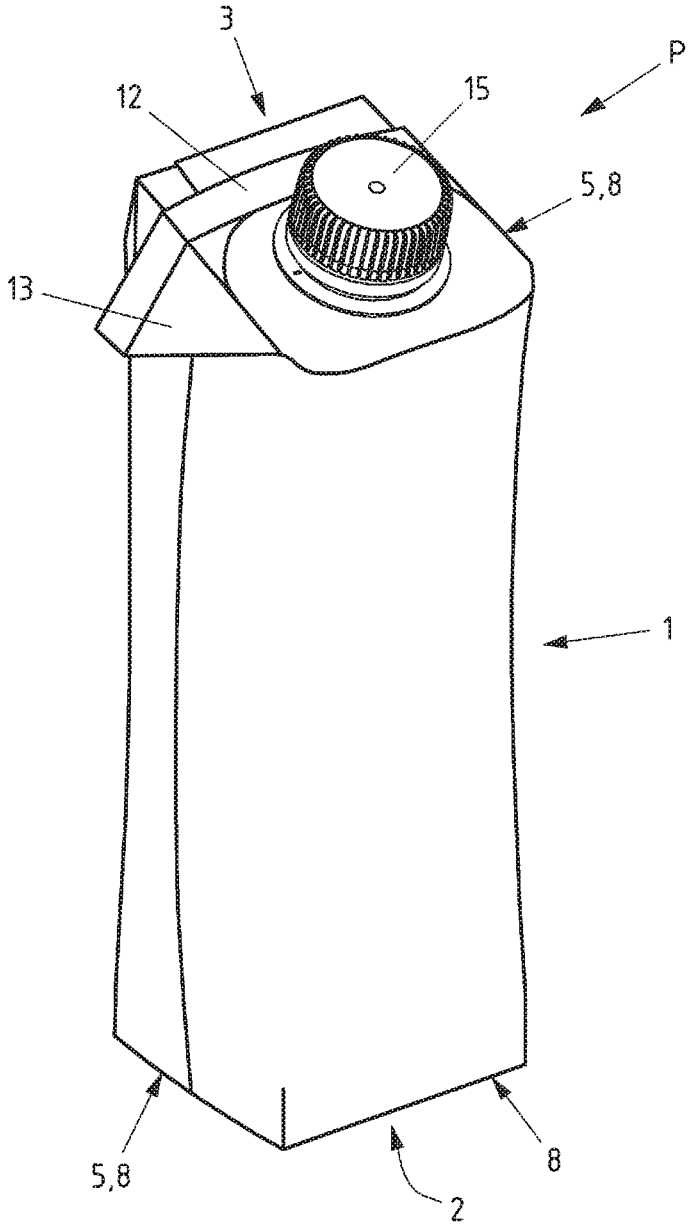
FIG. 1 is a composite package with pouring element according to the invention in perspective view above from the front.
Figure 8A:
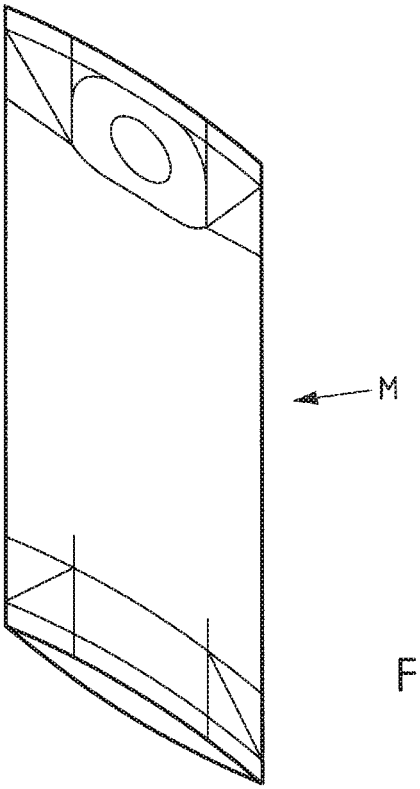

FIG. 8*a* is the front side of a package sleeve blank for manufacturing a composite package shown in FIG. 1 in perspective view.

Figure 8B:
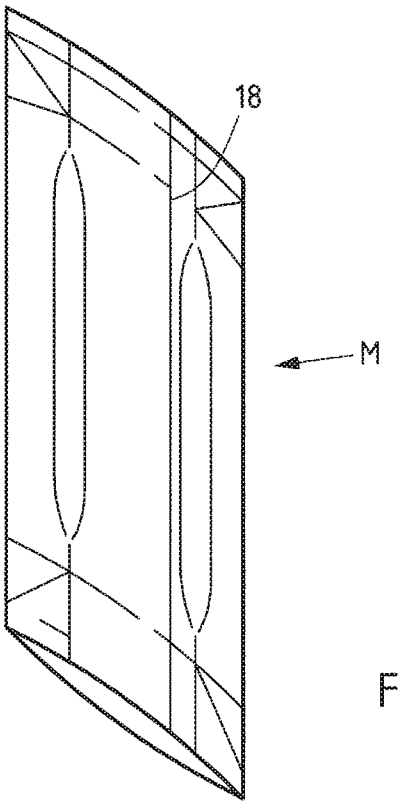

FIG. 8*b* is the rear side of the package sleeve blank from FIG. 8*a*.

DESCRIPTION OF THE INVENTION

The embodiment of a composite package P according to the invention depicted in FIG. 1 is formed by a package base body 1, a package base 2 sealing said package base body and a package gable 3 forming the head part of the package. All three parts are shaped by deforming fold processes from one and the same package material. Thus the package base 2 is shaped on a folding mandrel of a package machine via package fold lines 8 and sealed by means of ultrasound (alternatively hot air, adhesive, etc. are for example conceivable). The base-sealed semi-finished package product is then filled via the open head region with a desired filling material and a package gable 3 chamfered forwards towards the package base body 1 is then formed via further package fold lines 8 which seals the package by means of an ultrasonically welded transverse sealing seam 12. The excess package material sections resulting from the shaping of the package gable 3 form package ears 13 which are turned over via foldings on the package base body 1 and are attached to its side wall. Different defined package edges 5 result by the folding and shaping processes on the composite package P. In the embodiment shown, a pouring element 15 is applied on the package gable 3 from which the product can be poured out.

Figure 2:
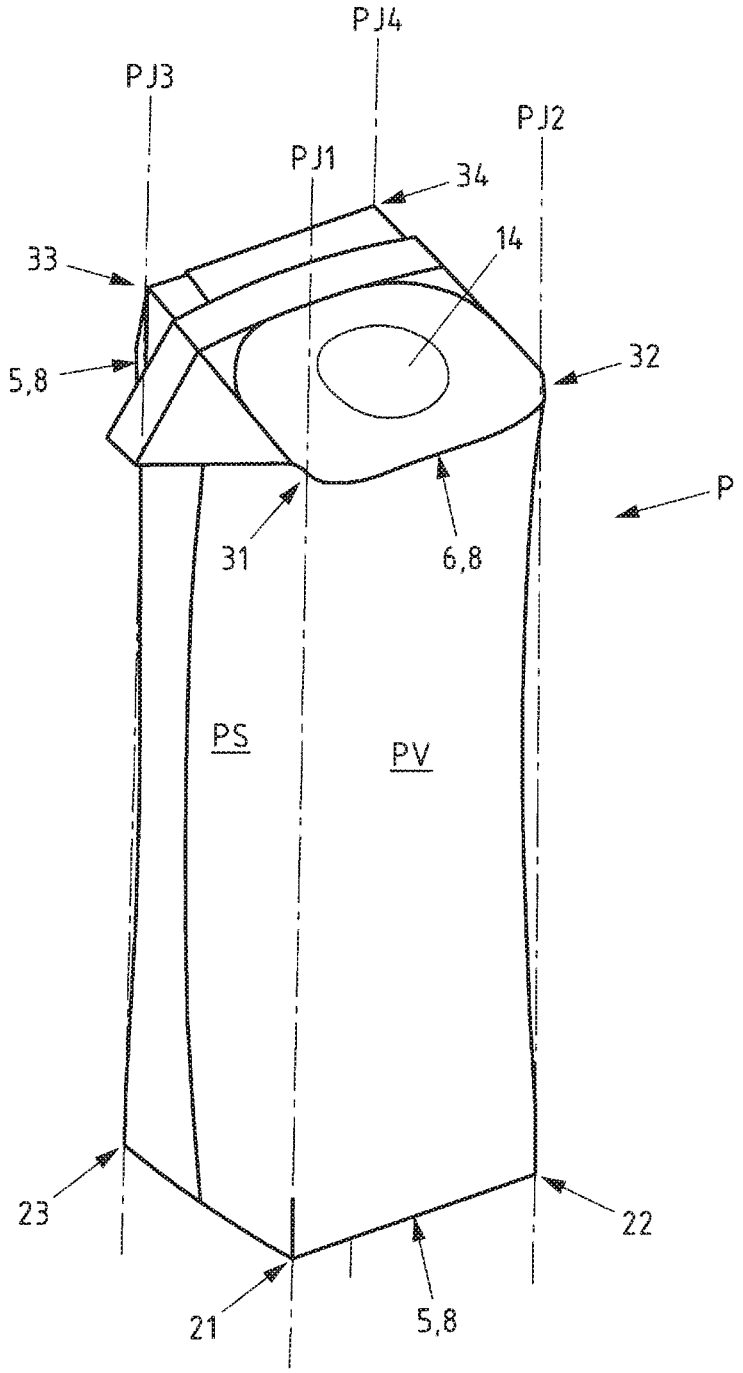
FIG. 2 is the composite package from FIG. 1 with faded-out pouring element in perspective view above from the front.

The pouring element is faded out from the depiction of FIG. 2 such that a local weakening 14 of the package material is visible. This serves for easy initial opening of the composite package P and is explained in greater detail further below. The composite package P has four package base corners 21, 22, 23, 24 and four package gable corners 31, 32, 33, 34. Further package fold lines 8 are formed on the package base body 1 which define further package edges 5 on the shaped composite package P.

In order to now describe the composite package P geometrically, projections PJ1, PJ2, PJ3, PJ4 are defined by the corners of the package base 2 and the package gable 3. The package base body defines a package vertical axis PA. The package vertical axis PA and the projections PJ1, PJ2, PJ3, PJ4 are located in the exemplary embodiment shown substantially parallel to each other. Package front side PV, the package rear side PH and two lateral package sides PS can be defined in an idealised manner via surfaces spread out on the projections PJ1, PJ2, PJ3, PJ4. These surfaces are delimited by the packages edges 5 on the package base 2 and package gable 3. Thus, for example, the front side PV is defined by the package edge 5 between the two front package base corners 21, 22 and the curved gable front edge 6 between the two front package gable corners 31, 32. The package ears 13 are attached at the two lateral package sides PS. The package front side PV is positively arched with regard to and along the package vertical axis PA. This positive arching 10 extends almost over the entire height of the package and is continued laterally via the projections PJ1, PJ2 and passes into the lateral package sides PS such that an ergonomic grip and hold of the package is facilitated for the consumer.

Figure 3:
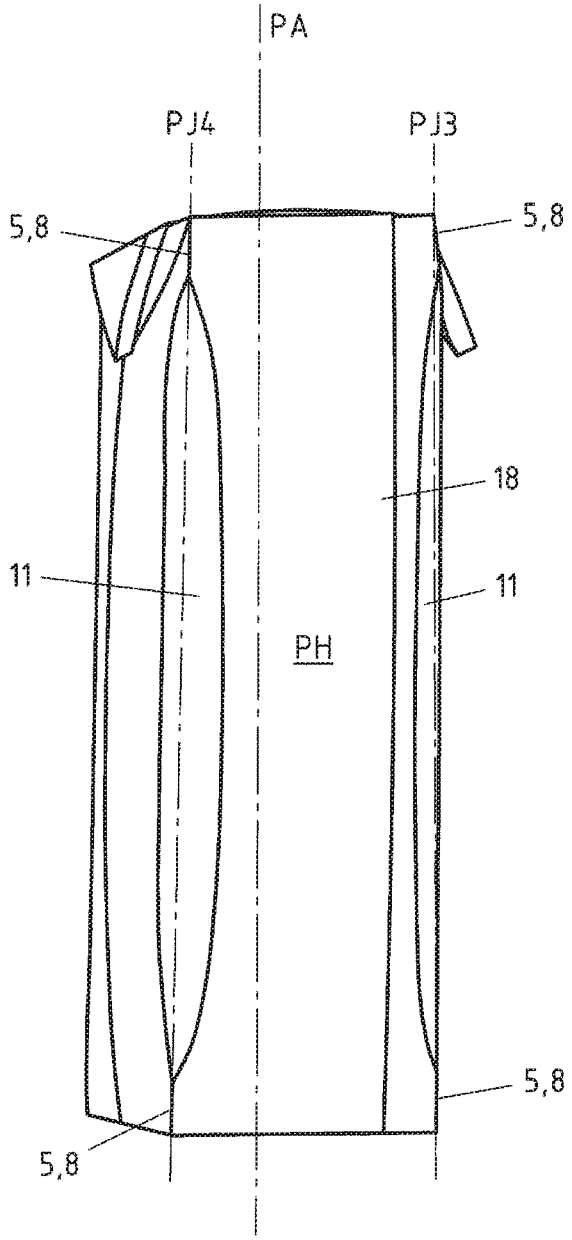
FIG. 3 is the composite package from FIG. 1 with faded-out pouring element in perspective view from behind.

FIG. 3 shows the package rear side PH of the finished composite package P with a longitudinal sealing seam 18. The rear projections PJ3, PJ4 are only formed in the region of the package base corners 23, 24 and in the region of the package gable corners 33, 34 as package edges 5. Instead of the package edges 5, grip panels 11 are formed over a relatively wide region. This facilitates an ergonomic grip and hold of the package for the consumer.

Figure 4:
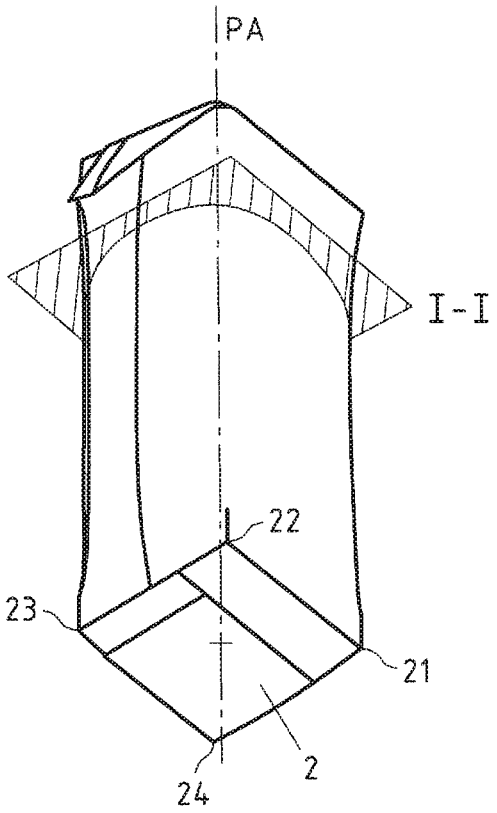
FIG. 4 is the composite package from FIG. 1 with faded-out pouring element below from the front.
Figure 5:
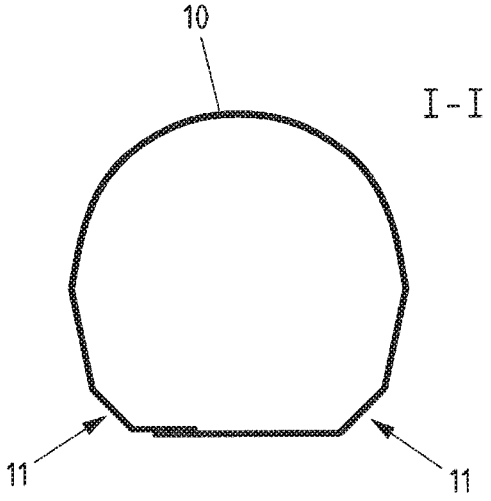
FIG. 5 is the composite package from FIG. 4 in plan view horizontally cut through the package base body in the grip and hold region.

FIG. 4 shows the composite package P from below. The package base 2 is designed in the exemplary embodiment as a block base. The grip and hold region of the package formed in the centre of the package is cut along the surface I-I such that the contour of the package material is visible in the cut view of FIG. 5. It shows the two grip panels 11 on the package rear side PH and the positive arching 10 on the package front side PV.

Figure 6:
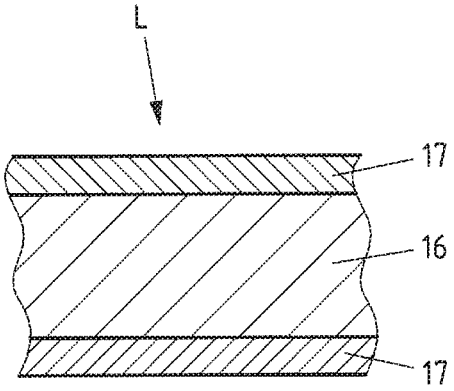
FIG. 6 is the package material used for the composite package from FIG. 1 in cross-section.

In FIG. 6, the cut structure of the package material is depicted with a carton support layer 16 which is laminated on both sides with a polymer layer 17. The weakening 14 is designed in the exemplary embodiment shown and in this respect preferred as a prelaminated hole. In this case, a hole is punched out of the carton support layer 16 prior to the laminating process such that the local weakening 14 is formed only by the polymer layers 17 in the finished package material.

Figure 7:
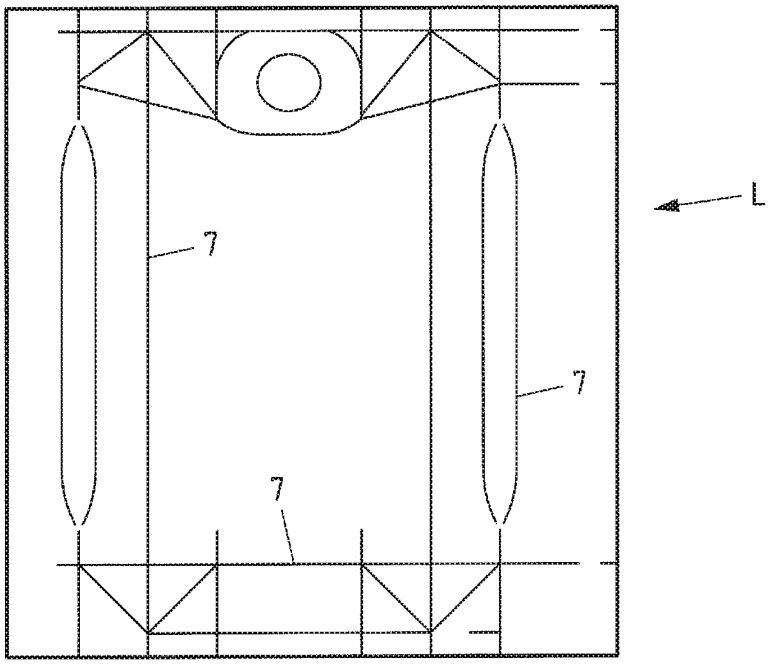
FIG. 7 is package laminate in the interval of a package for manufacturing a composite package shown in FIG. 1, in plan view.

FIG. 7 shows an interval of the package material provided with creases 7 as a ready-to-use package laminate L for forming a composite package P. The creases 7 predefine the subsequent fold lines 8 for the transport and package manufacture of which some form the subsequent package edges 5. The package laminate L is further printed with a decoration (not depicted) and is initially present as endless material (roll goods).

The upper and lower side of a package sleeve blank M cut to the interval of a composite package P to be made and connected via the longitudinal seam 18 to a pipe can be viewed in FIG. 8*a* and FIG. 8*b*. Said package sleeve blank M is laid flat via lateral fold lines for space-saving dispatch (for example in a cardboard box). The package sleeve blank M is lastly supplied to a package machine (operating here in the sleeve process) which shapes, fills and seals the composite package P.

The invention claimed is:

1. A composite package, in particular a beverage carton package for liquid foodstuffs which at least partially consists of a package laminate, having package base body comprising package edges, an at least partially angular package base and an at least partially angular package gable comprising a curved gable front edge having two front corners, wherein the package base body defines, in an idealised manner, a package front side, a package rear side and at least two lateral package sides attached to the package rear side which spread out substantially at intended projections by way of the respective package base corners and the respective package gable corners and are delimited in the gable and base region, the intended projections being straight vertical axes extending through the package base corners and the respective gable corners, wherein the package front side has a positive arching at least in sections, which extends across the package front side leading up to the curved gable front edge and continues over the projections defining the front side of the package, the positive arching passing into a lateral package side, the curved gable front edge being curved at the front corners to enable the positive arching to pass into the lateral package side at a height adjacent to the curved gable front edge, and wherein a grip panel is formed at least in sections in the region of at least one of the projections defining the package rear side, the grip panel extending between the package rear side and a lateral package side.

2. The composite package according to claim 1, wherein grip panels are formed at least in sections in the region of both projections defining the package rear side.

3. The composite package according to claim 1, wherein package edges are formed at least in the region of the rear package base corners in both projections defining the package rear side.

4. The composite package according to claim 1, wherein package edges are formed at least in the region of the rear package gable corners in both projections defining the package rear side.

5. The composite package according to claim 1, wherein the positive arching extends over half a height of the package base body.

6. The composite package according to claim 1, wherein the package gable is chamfered with respect to the package base body.

7. The composite package according to claim 1, wherein the package gable consists of package laminate.

8. The composite package according to claim 7, wherein the package gable comprises a transverse sealing seam and/or comprises package ears laterally connected to the package base body.

9. The composite package according to claim 7, wherein the package gable comprises a weakening of the package laminate.

10. The composite package according to claim 1, wherein a pouring element is applied to the package gable.

11. The composite package according to claim 1, wherein the package base comprises precisely four base corners.

12. The composite package according to claim 11, wherein the package base is formed as a block base.

13. A package laminate having at least one carton support layer and one polymer layer, having a plurality of creases incorporated into the material in order to predefine package fold lines to form package edges, wherein a composite package can be manufactured according to claim 1.

14. A package sleeve blank consisting of a package laminate having at least one carton support layer and one polymer layer, having a plurality of creases incorporated into the material in order to predefine package fold lines to form package edges, wherein the package laminate is cut to the interval of a composite package and is connected by a longitudinal sealing seam to a pipe, wherein a composite package can be manufactured according to claim 1.

15. The composite package according to claim, 1, wherein the positive arching passing into a lateral package side forms an arched contour extending between the package front side and the lateral package sides.

* * * * *